US010126683B2

(12) United States Patent
Ariizumi

(10) Patent No.: US 10,126,683 B2
(45) Date of Patent: Nov. 13, 2018

(54) DEVELOPING APPARATUS

(71) Applicant: CANON KABUSHIKI KAISHA, Tokyo (JP)

(72) Inventor: Osamu Ariizumi, Matsudo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/467,252

(22) Filed: Mar. 23, 2017

(65) Prior Publication Data

US 2017/0308004 A1 Oct. 26, 2017

(30) Foreign Application Priority Data

Apr. 22, 2016 (JP) ..... 2016-086443

(51) Int. Cl.
*G03G 15/08* (2006.01)

(52) U.S. Cl.
CPC ..... *G03G 15/0891* (2013.01)

(58) Field of Classification Search
CPC ..... G03G 15/0891; G03G 15/0893; G03G 15/0889
See application file for complete search history.

(56) References Cited

U.S. PATENT DOCUMENTS 8,224,225 B2 7/2012 Sakurai
8,326,180 B2 12/2012 Fujiwara et al.
9,348,262 B1 * 5/2016 Suenami ..... G03G 15/0889
9,442,427 B2 9/2016 Ishida et al.
2010/0028053 A1 * 2/2010 Kasai ..... G03G 15/0893 399/255
2010/0322670 A1 * 12/2010 Ishiguro ..... G03G 15/0853 399/254
2011/0236074 A1 * 9/2011 Maeda ..... G03G 15/0893 399/254
2012/0014718 A1 * 1/2012 Ikeda ..... G03G 15/0893 399/253

(Continued)

FOREIGN PATENT DOCUMENTS

JP S59-100471 A 6/1984
JP 2009-192554 A 8/2009

(Continued)

*Primary Examiner* — Sevan A Aydin
(74) *Attorney, Agent, or Firm* — Fitzpatrick, Cella, Harper & Scinto

(57) ABSTRACT

A developing apparatus includes a first screw disposed within a first chamber and conveying developer in a first direction, a second screw disposed within a second chamber and having a conveyance portion conveying the developer in a second direction opposite to the first direction and a return portion provided downstream of a first communication port in a first wall dividing the first and second chambers. A discharge portion in the second chamber, downstream of the return portion, discharges the developer out of the second chamber, and a second wall through which a third communication port is disposed upstream of the discharge portion is defined to deliver the developer from the second chamber to the first chamber. The second wall faces at least a part of the return portion in a view from a horizontal direction such that a lower end of the third communication port is located above a lower end of the first communication port.

8 Claims, 6 Drawing Sheets

(56) References Cited

U.S. PATENT DOCUMENTS

| | | | | |
|---|---|---|---|---|
| 2012/0189349 | A1* | 7/2012 | Okuno | G03G 15/0189 399/254 |
| 2013/0230333 | A1* | 9/2013 | Hirobe | G03G 15/0846 399/44 |
| 2014/0212180 | A1* | 7/2014 | Kadota | G03G 15/0893 399/254 |
| 2015/0003848 | A1* | 1/2015 | Sakaya | G03G 15/0831 399/27 |
| 2015/0003876 | A1* | 1/2015 | Iida | G03G 15/0891 399/254 |
| 2015/0139697 | A1* | 5/2015 | Tsukijima | G03G 15/0893 399/254 |
| 2016/0216640 | A1* | 7/2016 | Nose | G03G 15/0891 |
| 2016/0370734 | A1* | 12/2016 | Suenami | G03G 15/0889 |

FOREIGN PATENT DOCUMENTS

| | | | |
|---|---|---|---|
| JP | 2010-152045 | A | 7/2010 |
| JP | 2010-197539 | A | 9/2010 |
| JP | 2015-096891 | A | 5/2015 |
| JP | 2016-024353 | A | 2/2016 |

* cited by examiner

DEVELOPING APPARATUS

BACKGROUND OF THE INVENTION

Field of the Invention

The present disclosure relates to a developing apparatus suitable for an image forming apparatus using photo-electric technology such as a printer, a copier, a facsimile machine and a multi-function printer.

Description of the Related Art

An image forming apparatus such as a printer, a copier, a facsimile machine and a multi-function printer includes a developing apparatus configured to develop and to visualize an electrostatic latent image formed on a photosensitive drum by a developing agent. A two-component developing agent (referred to simply as 'developer' hereinafter) made of non-magnetic toner and magnetic carrier is used in the developing apparatus. As the developing apparatus, there is known a so-called function separated type configuration which includes a developing chamber configured to supply the developer to a developing sleeve and an agitating chamber configured to collect the developer stripped from the developing sleeve and which circulates the developer between the developing and agitating chambers as disclosed in Japanese Patent Application Laid-Open Nos. 2010-197539 and 2009-192554. The developing and agitating chambers are configured to communicate with each other through communication ports and include developing and agitating screws configured to convey the developer within the respective chambers.

If the developer reaches a condition in which the developer is stabilized, i.e., a so-called steady condition, in the case of the function separated type developing apparatus, a surface level of the developer in the agitating chamber increases gradually from upstream to downstream in a developer conveyance direction of the agitating screw. Then, the developer is delivered from the agitating chamber to the developing chamber through the communication port downstream in the developer conveyance direction of the agitating screw. It is noted that in the following description, 'upstream' or 'downstream' refers to upstream or downstream in the developer conveyance direction of the agitating screw unless specified otherwise.

There is also known a so-called carrier refreshing type (ACR type) apparatus configured to replenish new developer and to discharge extra developer out of a discharge port because carrier deteriorates and electrifying performance drops in response to image forming operations as disclosed in Japanese Patent Application Laid-open No. S59-100471 for example. As an exemplary carrier refreshing type developing apparatus, there is known an apparatus including a return screw configured to convey the developer in a direction opposite to that of the agitating screw downstream of the agitating screw and a discharge port defined downstream of the return screw. In the case of this apparatus, a part of the developer moved downstream against a conveying force of the return screw among the developer conveyed by the agitating screw is discharged out of the discharge port.

If fluidity of the developer drops in the function separated type developing apparatus, the developer is suppressed from being delivered from the agitating chamber to the developing chamber and a surface level of the developer within the agitating chamber is apt to increase. If the surface level of the developer increases within the agitating chamber, the developer is put into a condition in which the developer is in contact with a surface of a developing sleeve and is apt to be rotated with the developing sleeve. Therefore, it is preferable to provide the discharge port and to be able to discharge the developer.

In such a case, because most of the developer is delivered to the developing chamber before the developer heads to the discharge port if the return screw is provided at a position, facing the communication port, it is possible to control the discharge of the developer. In contrast, if a width of the communication port is reduced to suppress the apparatus from enlarging in a conveyance direction of the screw, an amount of the developer to be delivered from the agitating chamber to the developing chamber decreases, and an amount of the developer discharged out of the discharge port increases.

SUMMARY OF THE INVENTION

Accordingly, the present disclosure provides a developing apparatus configured to optimize an amount of developer discharged out of a discharge port in a function separated type developing apparatus.

According to one aspect of the present disclosure, a developing apparatus includes a developer bearing member configured to be rotatable, a first chamber configured to supply developer to the developer bearing member, a second chamber configured to collect the developer conveyed from the developer bearing member and to form a circulation path of the developer with the first chamber, a first wall dividing the first chamber from the second chamber and through which a first communication port delivering the developer from the second chamber to the first chamber and a second communication port delivering the developer from the first chamber to the second chamber are defined, a first screw disposed within the first chamber and conveying the developer in a first direction, a second screw disposed within the second chamber, including a first conveyance portion configured to convey the developer in a second direction opposite to the first direction and a return portion provided downstream in the second direction and downstream of the first communication port and configured to convey the developer in the first direction, a discharge portion provided in the second chamber downstream of the return portion in the second direction to discharge the developer out of the second chamber, and a second wall through which a third communication port is defined upstream of the discharge portion in the second direction to deliver the developer from the second chamber to the first chamber. The second wall faces at least a part of the return portion in an axial direction of the second screw such that a lower end of the third communication port is located above a lower end of the first communication port.

Further features of the present invention will become apparent from the following description of exemplary embodiments with reference to the attached drawings. The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Figure 1:
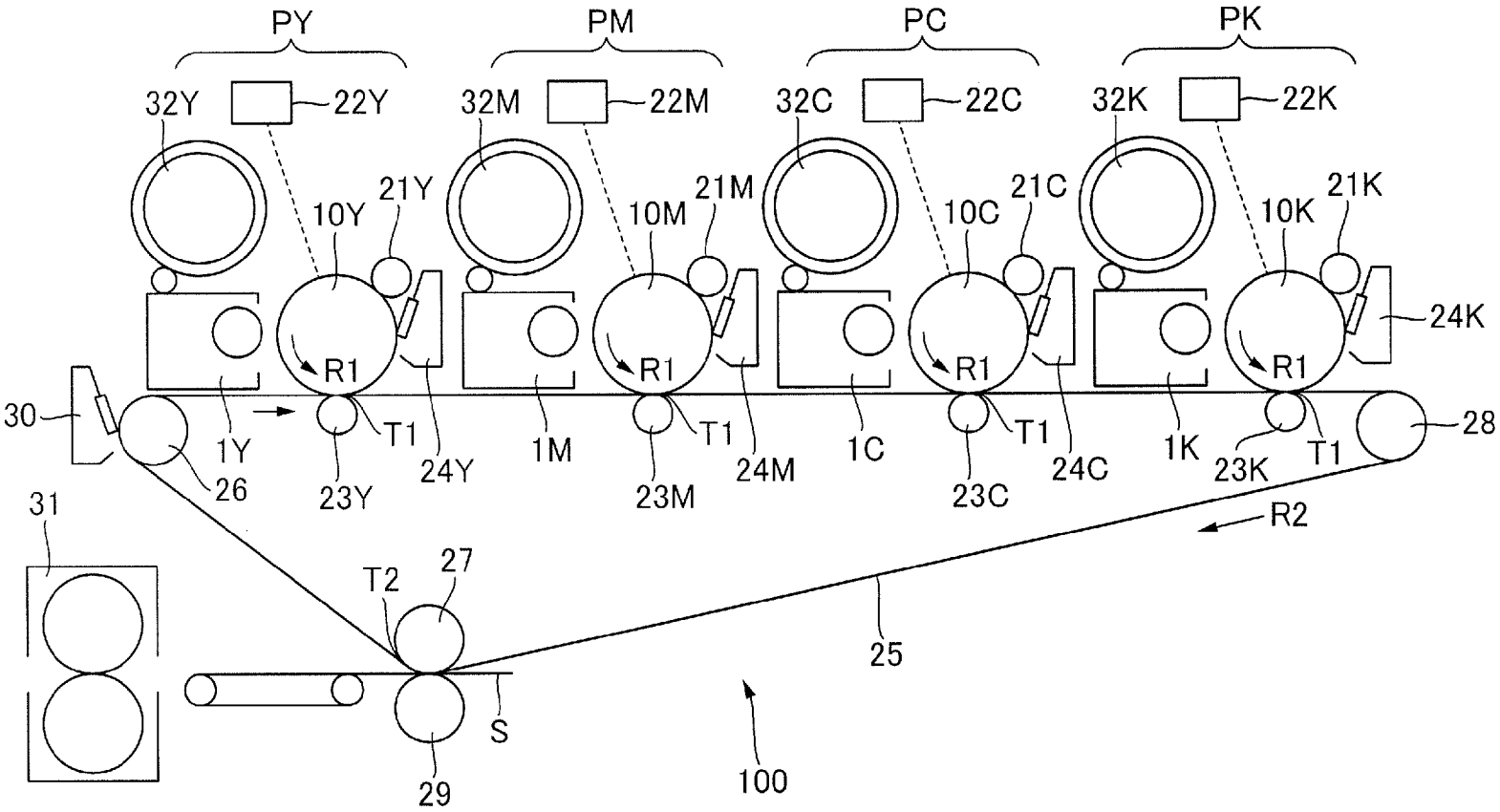
FIG. 1 is a schematic diagram illustrating a configuration of an image forming apparatus to which a developing apparatus of a present embodiment is applied.

A configuration of an image forming apparatus to which a developing apparatus of a present embodiment is applied will be described first with reference to FIG. 1. The image forming apparatus 100 illustrated in FIG. 1 is an intermediate transfer full-color printer of a tandem type in which image forming portions PY, PM, PC, and PK are arrayed along an intermediate transfer belt 25.

Image Forming Apparatus

In the image forming portion PY, a yellow toner image is formed on a photosensitive drum 10Y and is transferred onto the intermediate transfer belt 25. In the image forming portion PM, a magenta toner image is formed on a photosensitive drum 10M and is transferred onto the intermediate transfer belt 25. In the image forming portions PC and PK, cyan and black toner images are formed on photosensitive drums 10C and 10K, respectively, and are transferred onto the intermediate transfer belt 25. The four color toner images transferred onto the intermediate transfer belt 25 are conveyed to a secondary transfer portion (secondary transfer nip portion) T2 and are collectively secondarily transferred onto a recording material S, i.e., a sheet material such as a sheet of paper and an OHP sheet. The recording material S has been taken one by one out of a sheet feed cassette not illustrated and has been conveyed to the secondary transfer portion T2.

The image forming portions PY, PM, PC and PK are configured approximately in a same manner with each other except that the colors of the toners are different as yellow, magenta, cyan and black. The configuration and operation of the respective image forming portions PY through PK will be described below while omitting Y, M, C, and K which are subscripts of reference numerals distinguishing the image forming portions PY, PM, PC and PK.

The image forming portion P includes an electrifying roller 21, an exposure unit 22, a developing apparatus 1, a transfer roller 23, and a drum cleaning unit 24 around the photosensitive drum 10 serving as an image bearing member. The photosensitive drum 10 is what a photosensitive layer is formed on an outer circumferential surface of an aluminum-made cylinder and rotates in a direction of an arrow R1 in FIG. 1 with a predetermined processing speed.

The electrifying roller 21 to which electrification potential is applied electrifies the photosensitive drum 10 with a homogeneous negative dark part potential by coming into contact with the photosensitive drum 10. The exposure unit 22 generates a laser beam, which is ON-OFF modulated according to a scan line image data in which a color separation image of each color is developed, from a light emitting element and scans the beam by a rotational mirror to draw an electrostatic image of the image on a surface of the electrified photosensitive drum 10. The developing apparatus 1 supplies toner to the photosensitive drum 10 to develop the electrostatic image as a toner image. The developing apparatus 1 will be detailed later (see FIGS. 2 through 6).

The transfer roller 23 is disposed so as to face the photosensitive drum 10 with the intermediate transfer belt 25 between them and forms a primary transfer portion (primary transfer nip portion) T1 of the toner image between the photosensitive drum 10 and the intermediate transfer belt 25. The toner image is primarily transferred from the photosensitive drum 10 onto the intermediate transfer belt 25 at the primary transfer portion T1 by a primary transfer voltage applied to the transfer roller 23 from a high voltage source not illustrated for example. That is, in response to the application of the primary transfer voltage whose electrification polarity is inverse to that of the toner to the transfer roller 23, the toner image on the photosensitive drum 10 is electrostatically attracted and transferred onto the intermediate transfer belt 25. The drum cleaning unit 24 rubs the photosensitive drum 10 with a cleaning blade to remove primary transfer residual toner slightly left on the photosensitive drum 10 after the primary transfer.

The intermediate transfer belt 25 is supported by being suspended around rollers such as a tension roller 26, a secondary transfer inner roller 27 and a driving roller 28 and is rotated in a direction of an arrow R2 in FIG. 1 by being driven by the driving roller 28. The secondary transfer portion T2 is a nip portion defined by bringing the secondary transfer inner roller 27 into contact with the intermediate transfer belt 25 supported by a secondary transfer outer roller 29 and configured to transfer the toner image onto the recording material S. In the secondary transfer portion T2, the toner image is secondarily transferred from the intermediate transfer belt 25 onto the recording material S, which is nipped and conveyed by the secondary transfer portion T2, by a predetermined secondary transfer voltage applied to the secondary transfer inner roller 27. Secondary transfer residual toner adhering and left on the intermediate transfer belt 25 after the secondary transfer is removed by a belt cleaning unit 30 which rubs the intermediate transfer belt 25. That is, the belt cleaning unit 30 removes the secondary transfer residual toner by rubbing a cleaning blade to the intermediate transfer belt 25.

The recording material S onto which the four color toner images have been transferred at the secondary transfer portion T2 is conveyed to a fixing unit 31. The fixing unit 31 melts and fixes the toner images onto the recording material S by pressure applied by a roller or a belt not illustrated and facing with each other and by heat applied in general from a heat source such as a heater not illustrated. The recording material S onto which the toner image has been fixed by the fixing unit 31 is discharged out of the image forming apparatus.

A toner replenishing unit 32 is configured to be able to replenish toner, i.e., more specifically replenishing toner, of an amount equivalent to an amount of toner consumed by the developing apparatus 1 in the image forming process to the developing apparatus 1.

Developing Apparatus

Figure 2:
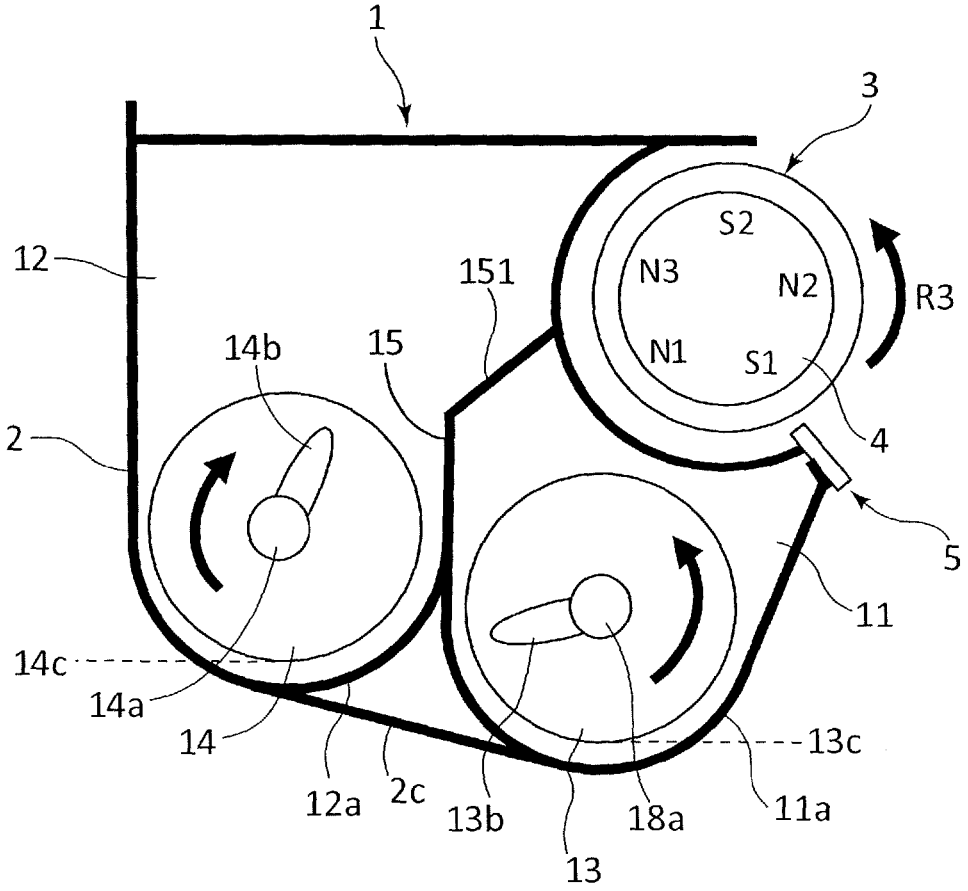
FIG. 2 is a section view illustrating the developing apparatus of the present embodiment.

The developing apparatus 1 of the present embodiment will be described below with reference to FIGS. 2 through 6. As illustrated in FIG. 2, the developing apparatus 1 includes a developing container 2 defining a housing, a developing sleeve 3 as a developer bearing member, a regulating blade 5, a developing screw 13 serving as a first screw, an agitating screw 14 serving as a second screw, and others.

A two-component developer containing non-magnetic toner and magnetic carrier is stored in the developing container 2. That is, a two-component developing system is used as a developing system in the present embodiment, and the developer in which the non-magnetic toner of minus charging polarity is blended with the magnetic carrier of plus charging polarity is used. The non-magnetic toner is what a colorant, wax components and others are included in resin such as polyester and styrene acryl is pulverized by crushing or polymerization. The magnetic carrier is what a resin coating is applied to a surface layer of a core of a resin particle in which ferrite particle and magnetic powder are kneaded. Toner concentration within the developer in an initial condition, i.e., a rate (ratio) of weight of toner occupied in a total weight of the developer (referred to also as 'TD ratio'), is 8% for example in the present embodiment.

A part of the developing container 2 facing the photosensitive drum 10 (see FIG. 1) is opened, and the developing sleeve 3 serving as the developer bearing member is disposed rotatably such that a part of the developing sleeve 3 is exposed out of the opening. The developing sleeve 3 is formed into a cylindrical shape by a non-magnetic material such as aluminum alloy and is rotationally driven in a direction of an arrow R3 in FIG. 2. Disposed unrotationally within the developing sleeve 3 is a magnet roller 4 composed of a plurality of magnetic poles.

The developing sleeve 3 rotates in the direction of the arrow R3 in FIG. 2 and bears and conveys the developer attracted at a position of a draw-up magnetic pole N1 of the magnetic roller 4 in a direction of a regulating blade 5. An amount of the developer napped by a regulating magnetic pole S1 is regulated by receiving a shearing force from the regulating blade 5 when the developer passes through a gap between the developing sleeve 3 and the regulating blade 5 such that a developer layer of a predetermined thickness is formed on the developing sleeve 3. The developer layer thus formed is borne and conveyed to a developing area facing the photosensitive drum 10 and develops the electrostatic latent image formed on the surface of the photosensitive drum 10 in a condition in which the magnetic naps are formed by a developing magnetic pole N2. The developer left after the development is stripped from the developing sleeve 3 at a non-magnetic zone formed between a stripping magnetic pole N3 and the draw-up magnetic pole N1 which are like-poles adjacent with each other.

Developing Container

The developing container 2 includes a developing chamber 11 serving as a first chamber and an agitating chamber 12 serving as a second chamber and is provided with a partition wall 15 serving as a first partition wall dividing the developing chamber 11 from the agitating chamber 12. The partition wall 15 divides the developing chamber 11 from the agitating chamber 12 such that the partition wall 15 projects out of a bottom surface 2*c* within the developing container 2. The partition wall 15 extends in a rotation axial direction of the developing sleeve 3, and the developing and agitating chambers 11 and 12 are defined along the rotation axial direction of the developing sleeve 3. Then, according to the present embodiment, the developing chamber and agitating chambers 11 and 12 are disposed with a difference of level such that a bottom surface 12*a* of the agitating chamber 12 is located above a bottom surface 11*a* of the developing chamber 11 when viewed from a horizontal direction.

Figure 3:
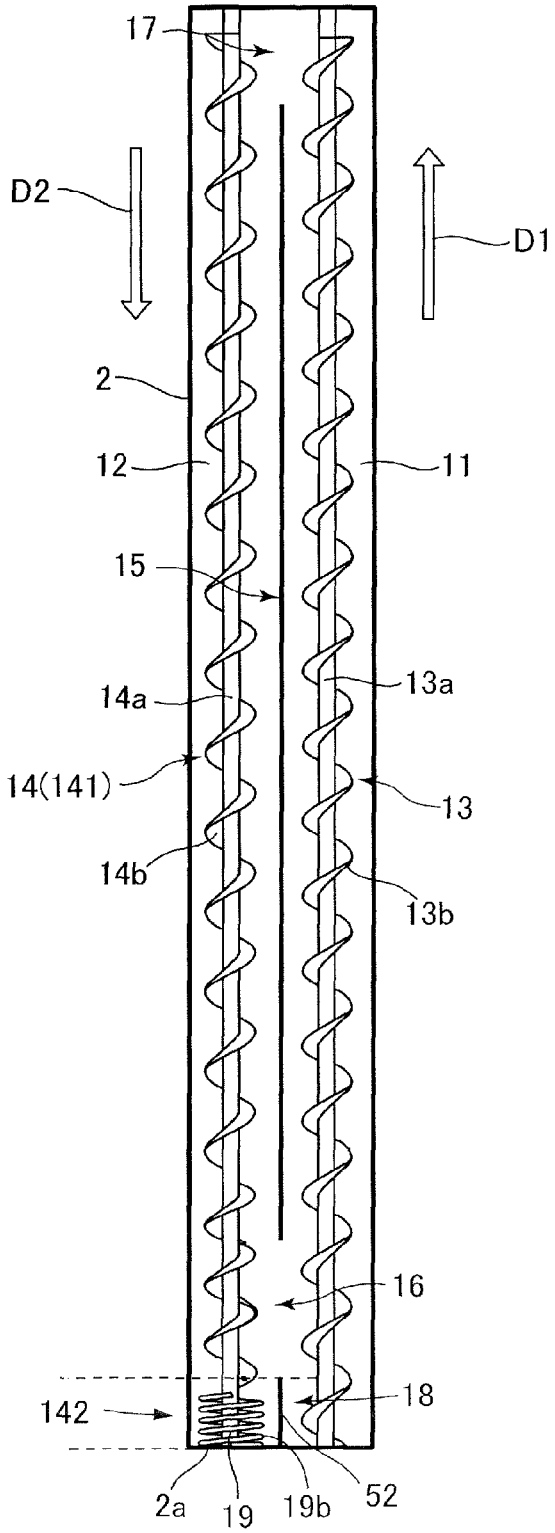
FIG. 3 is an upper section view illustrating the developing apparatus in a view of a horizontal section including an axial direction.

As illustrated in FIG. 3, the partition wall 15 includes first and second communication ports 16 and 17 communicating the developing chamber 11 with the agitating chamber 12 respectively at longitudinal both ends of the partition wall 15. The first communication port 16 is a developer delivering portion that allows the developer to be delivered from the agitating chamber 12 to the developing chamber 11, and the second communication port 17 is a developer delivering portion that allows the developer to be delivered from the developing chamber 11 to the agitating chamber 12. In terms of length in the rotation axial direction (longitudinal direction) of the agitating screw 14, the first and second communication ports 16 and 17 are both formed to be 30 mm. Besides the first and second communication ports 16 and 17, a third communication port 18 is defined through the partition wall 15. Similarly to the first communication port 16, the third communication port 18 is defined to be able to deliver the developer from the agitating chamber 12 to the developing chamber 11. The third communication port 18 will be described in detail later (see FIG. 4). As illustrated in FIG. 2, a guide member 151 extending so as to approach the developing sleeve 3 to guide the developer stripped from the developing sleeve 3 to the agitating chamber 12 is provided at an upper part of the partition wall 15. Preferably, the guide member 151 is provided across a range at least including a coating area capable of bearing the developer of the developing sleeve 3.

As illustrated in FIG. 3, the developing chamber 11 is provided with the developing screw 13 configured to convey the developer in a predetermined first direction D1 in the developing chamber 11. The agitating chamber 12 is provided with the agitating screw 14 including a first conveyance portion 141 conveying the developer in a second direction D2 opposite to that of the developing screw 13 in the agitating chamber 12. The developing and agitating screws 13 and 14 are constructed by forming blades 13*b* and 14*b* spirally around rotary shafts 13*a* and 14*a*, respectively. Both ends of the rotary shafts 13*a* and 14*a* are rotatably supported by the developing container 2, respectively. The developing and agitating screws 13 and 14 are disposed such that at least parts thereof overlap with each other when viewed from the horizontal direction. According to the present embodiment, the developing and agitating screws 13 and 14 are disposed such that a lower end 14*c* of the agitating screw 14 is located above a lower end 13*c* of the developing screw 13 when viewed from the horizontal direction as illustrated in FIG. 2. The developing and agitating screws 13 and 14 are formed such that shaft diameters of the rotary shafts 13*a* and 14*a* are 6 mm, diameters of the blades 13*b* and 14*b* are 18 mm, and a screw pitch is 40 mm for example.

The developing sleeve 3, the developing screw 13 and the agitating screw 14 are configured to be linked and driven respectively by a gear train not illustrated and are also rotated respectively through an intermediary of a gear train linked to a driving motor also not illustrated. The developer is circulated and conveyed as indicated by arrows in FIG. 3 in response to rotations of the developing and agitating screws 13 and 14. At this time, the developer is delivered from the agitating chamber 12 to the developing chamber 11 at the first communication port 16 and is delivered from the developing chamber 11 to the agitating chamber 12 at the second communication port 17. Thus, a developer circulation path is formed by the developing and agitating chambers 11 and 12, and the developer is mixed and agitated by circulating through the circulation path.

The developing chamber 11 is configured to supply the developer to the developing sleeve 3, and the agitating chamber 12 is configured to collect the developer stripped from the developing sleeve 3. That is, while being conveyed by the developing screw 13, the developer within the developing chamber 11 is attracted to the developing sleeve 3 at the position of the draw-up magnetic pole N1 of the magnet roller 4. Meanwhile, the guide member 151 provided at the upper part of the partition wall 15 extends from the upper end of the partition wall 15 to be close to the developing sleeve 3 around the non-magnetic zone of the developing sleeve 3. Therefore, the developer stripped from the developing sleeve 3 at the stripping magnetic pole N3 is stored in the agitating chamber 12 without returning to the developing chamber 11. While collecting the developer, the agitating chamber 12 is configured to convey the collected developer by the agitating screw 14.

By the way, charge amount imparting ability, i.e., electrifying performance, to the toner of the carrier may drop as the image forming operation advances in the developing apparatus 1 developing an image by using the two-component developer. If it happens, the toner charging amount drops, and such image defects as a variation in density, toner scattering and image fogging may occur. Then, in order to recover the electrifying performance of the carrier, a control of refreshing the carrier (so-called ACR method) is made by replenishing agent from a toner replenishing unit 32 (see FIG. 1) connected with a replenishing port not illustrated and defined through the developing apparatus 1. In the ACR type developing apparatus, the extra developer caused by the replenishment of the developer overflows from the discharge port and is discharged out of the developing container 2. Thereby, the developer within the developing container 2 is kept at a constant amount even if the developer is replenished.

Discharge Port

Figure 4:
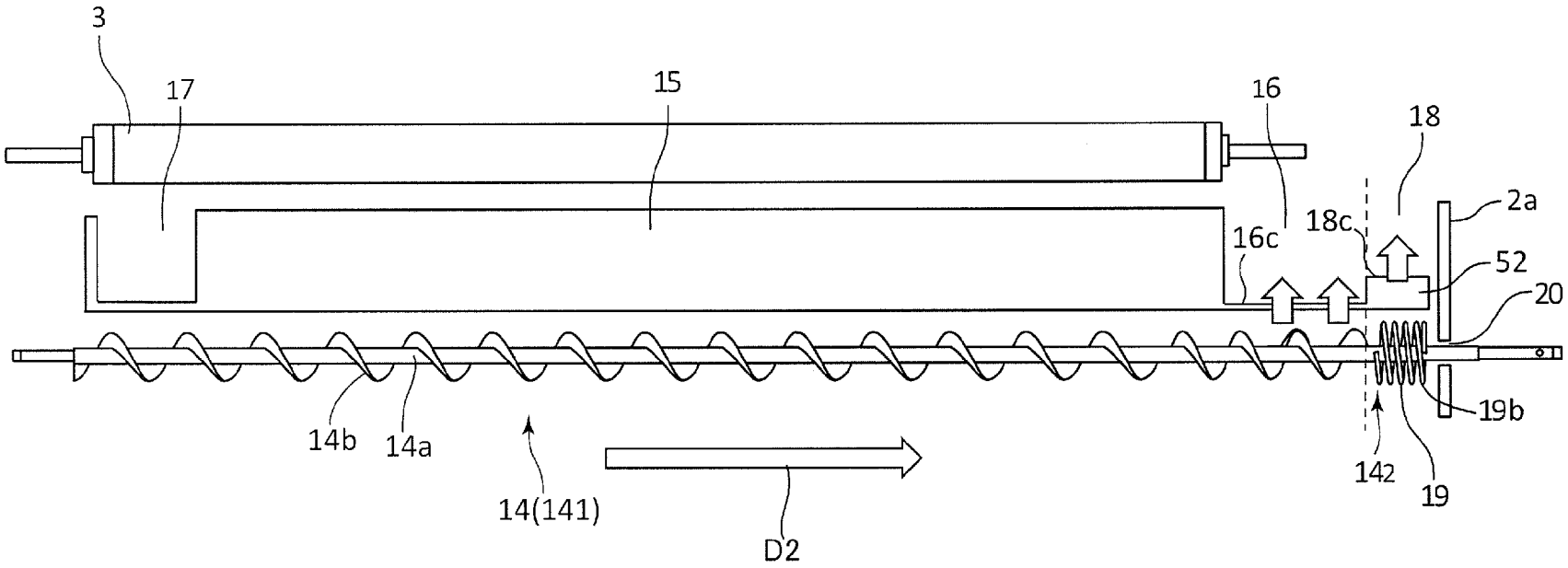
FIG. 4 is a schematic diagram illustrating a third communication port.
Figure 5:
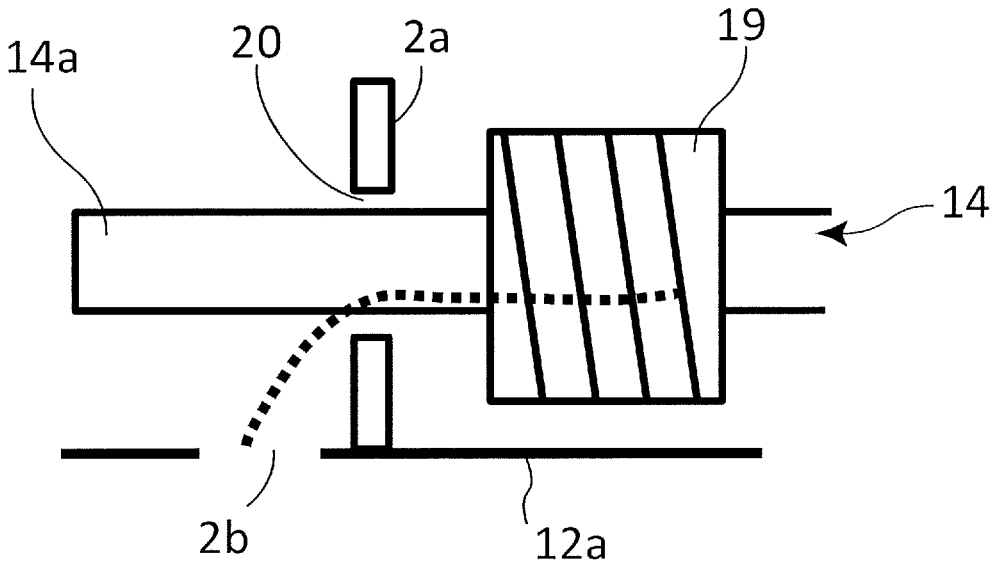
FIG. 5 is an enlarged schematic diagram illustrating a discharge port and a return screw.

As illustrated in FIG. 4, the developing container 2 (see FIG. 3) includes a discharge port 20 serving as a first discharge portion defined through a wall 2*a* serving as a third wall disposed at an end downstream of the agitating chamber 12, i.e., downstream in the second direction D2, in a direction intersecting with a developer conveyance direction and configured to discharge the developer out of the agitating chamber 12. As illustrated in FIG. 5, the discharge port 20 is defined as a through hole through which a shaft portion of the rotary shaft 14*a* of the agitating screw 14, around which no blade is formed, penetrates and having a gap between an outer circumference of the rotary shaft 14*a* at the shaft portion. For instance, while the rotary shaft 14*a* of the agitating screw 14 is formed to be 6 mm in diameter, the discharge port 20 is defined to be 8 mm in diameter.

Returning to FIG. 4, it is conceivable to define the discharge port not through the wall 2*a* at the end of the developing container 2 but on a way of the conveyance path of the agitating chamber 12, i.e., at a predetermined level of a side wall surface facing the first conveyance portion 141. In this case, however, the developer may be discharged not only by the overflow from the discharge port but also by being jumped up by the agitating screw 14. That is, as compared to the present embodiment in which the discharge port is defined through the wall 2*a* at the end of the developing container 2, the developer may be reduced too much in some case because the developer is apt to be discharged regardless of an amount of the developer stored in the agitating chamber 12. Then, enough of an amount of developer cannot be assured upstream in the developer conveyance direction of the developing screw 13 in the developing chamber 11 in particular, and the coating area of the developing sleeve 3 is hardly equally coated. If the coating failure occurs, such image defect that image density is thinned or a white stripe is generated on the image may occur. In order to avoid such case, it is preferable to define the discharge port 20 through the wall 2*a* of the end of the developing container 2, like the present embodiment, where the jump up of the developer hardly occurs.

Return Screw

As illustrated in FIG. 4, the agitating screw 14 includes a return portion 142 downstream of the first conveyance portion 141 in which the blade 14*b* is formed around the rotary shaft 14*a*, i.e., downstream in the second direction D2, or more specifically between a downstream end of the blade 14*b* and the discharge port 20. The return portion 142 includes a return screw 19 composed of a return screw 19*b* wound around the rotary shaft 14*a* in a direction opposite to that of the blade 14*b* and conveying the developer in the first direction D1, i.e., in the direction opposite to that of the blade 14*b*. The return screw 19 is formed such that a screw pitch is 3 mm and a length in the rotation axial direction, i.e., the longitudinal direction, of the agitating screw 14 is 15 mm.

In a case when a significant amount of the developer reaches to a downstream end of the first conveyance portion 141 of the agitating screw 14 and a surface level of the developer reaches a level of the gap between the rotary shaft 14*a*, i.e., a rotary shaft portion, and the discharge port 20, the developer is discharged out of the gap. That is, a large amount of the developer conveyed by the first conveyance portion 141 toward the discharge port 20 is pushed back upstream, i.e., upstream in the second direction D2, by the return screw 19 and is delivered to the developing chamber 11 through the first communication port 16 without delivering through the discharge port 20. Meanwhile, the developer not pushed back by the return screw 19 moves from the discharge port 20 to a downstream side of the agitating chamber 12 corresponding to the surface level of the developer that becomes higher than a lower end of the discharge port 20. As illustrated in FIG. 5, the agitating chamber 12 is provided with a connection port 2*b* serving as a second discharge portion discharging the developer out of the developing apparatus 1 and defined through a bottom surface 12*a* of the agitating chamber 12 downstream of the wall 2*a*. The developer is then collected into a collection container not illustrated and connected with the connection port 2*b*.

The developing apparatus 1 of the present embodiment has a so-called function separated configuration in which the developing chamber 11 supplies the developer to the developing sleeve 3 and the agitating chamber 12 collects the developer from the developing sleeve 3. The developer on the developing sleeve 3 is collected across the longitudinal direction of the agitating chamber 12 in the function separated developing apparatus 1. Therefore, the developer is circulated through two paths of a first path through which the developer is conveyed from the developing chamber 11 to the agitating chamber 12 without delivering through the developing sleeve 3 and a second path through which the developer is conveyed from the developing sleeve 3 directly to the agitating chamber 12. Then, distribution of the amount of the developer is apt to become non-uniform within the developing container 2. The developer is apt to accumulate downstream in the agitating chamber 12, so that the surface level of the developer is apt to become high downstream.

As described above, if fluidity of the developer drops in a prior art developing apparatus, the developer is suppressed from being delivered from the agitating chamber 12 to the developing chamber 11. Then, the image defect such as density unevenness for example is apt to occur due to the developer whose toner density is low being rotated together with the developing sleeve 3. Still further, because not enough of an amount of developer can be assured upstream in the developer conveyance direction of the developing screw 13 within the developing chamber 11, i.e., downstream in the developer conveyance direction of the agitating screw 14, the image defect caused by the coating failure described above may occur. Third communication port Then, as illustrated in FIGS. 3 and 4, a third communication port 18 is provided through the partition wall 15 besides the first and second communication ports 16 and 17 in the present embodiment in order not to suppress the delivery of the developer from the agitating chamber 12 to the developing chamber 11. The third communication port 18 is disposed downstream adjacently of the first communication port 16 and facing the return screw 19 when viewed from the horizontal direction. For instance, in terms of length in the rotation axial direction, i.e., the longitudinal direction, of the agitating screw 14, the first and second communication port 16 and 17 are defined to be 30 mm and the third communication port 18 to be 20 mm. In this case, the length in the longitudinal direction of the third communication port 18, i.e., 20 mm, is longer than a length in the longitudinal direction of the return screw 19, i.e., 15 mm. That is, it is preferable to define the third communication port 18 in a range across a whole range in the longitudinal direction of the return screw 19. This arrangement makes it possible to readily improve the delivery of the developer from the agitating chamber 12 to the developing chamber 11.

As described above, the third communication port 18 improves the delivery of the developer from the agitating chamber 12 to the developing chamber 11. However, if the third communication port 18 is practically what the first communication port 16 is merely widened downstream as compared to a prior art one, most of the developer is delivered to the developing chamber 11 and the discharge of the developer from the discharge port 20 is suppressed. In order to avoid this case, according to the present embodiment, a lower end 18*c* of the third communication port 18 is defined above a lower end 16*c* of the first communication port 16 as illustrated in FIG. 4.

That is, in the ACR type developing apparatus, an amount of the developer discharged out of the discharge port 20, i.e., a discharge amount, varies depending on the surface level of the developer. That is, the surface level of the developer in a vicinity of the discharge port 20 affects the discharge of the developer. For instance, if the surface level of the developer is always lower than the discharge port 20, extra developer is hardly discharged even if the developer is replenished. As a result, the developer within the developing container 2 increases unnecessarily and may leak out of the developing container 2 or may cause agglomerate which is one cause of the coating failure. Accordingly, the surface level of the developer must reach an adequate level with respect to the discharge port 20 in some cases in the vicinity of the discharge port 20. However, the surface level of the developer is rendered always to be lower than the discharge port 20 in the vicinity of the discharge port 20 just by widening the first communication port 16 by adding the third communication port 18 as described above.

Figure 6:
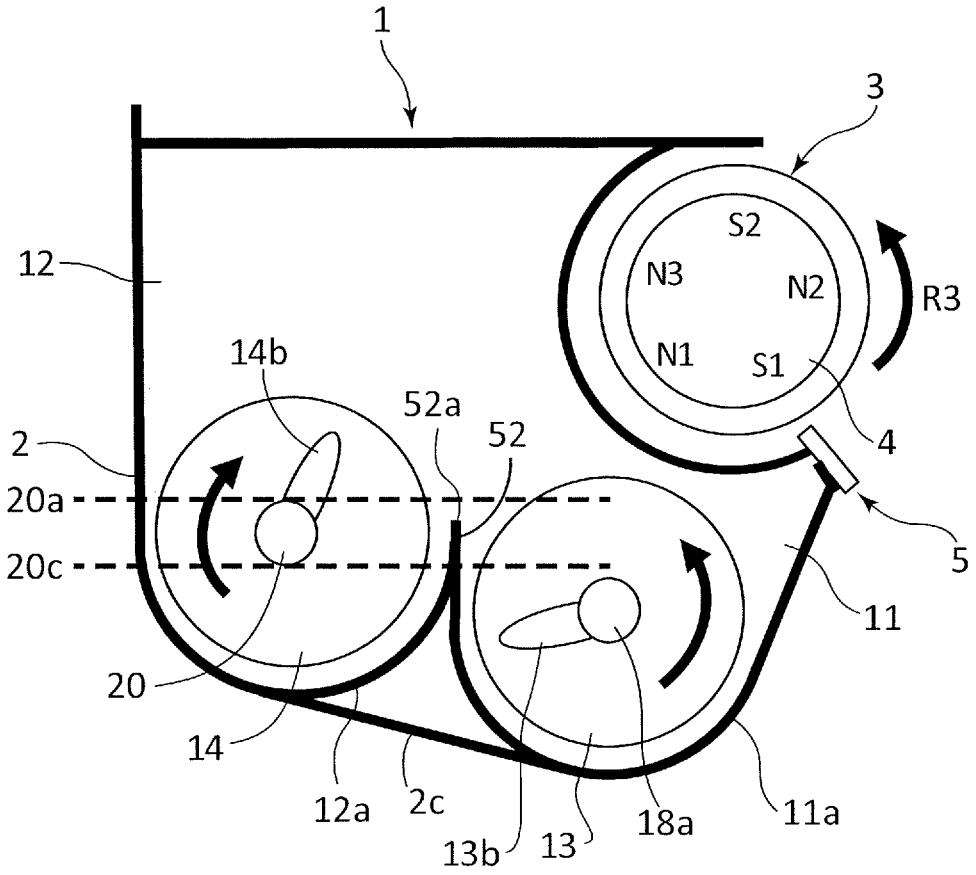
FIG. 6 is a section view illustrating the third communication port.

Then, the lower end 18*c* of the third communication port 18 is defined above the lower end 16*c* of the first communication port 16. The third communication port 18 is formed of a partition wall 52 dividing the developing chamber 11 from the agitating chamber 12 in a range overlapping with the return portion 142 among the partition wall 15 (see FIG. 4). Therefore, as illustrated in FIG. 6, the partition wall 52 extends from the bottom surface 2*c* such that an uppermost end 52*a* thereof (correspond to the lower end 18*c* of the third communication port 18) reaches between upper and lower ends 20*a* and 20*c* of the discharge port 20 when viewed from the horizontal direction. In this case, the partition wall 52 assures an amount of the developer conveyed to the discharge port 20 side by preventing the developer from entering the third communication port 18. The amount of the developer conveyed to the discharge port 20 side is determined by the height of the partition wall 52 and also by the position of the lower end 18*c* of the third communication port 18. This arrangement makes it possible for the surface level of the developer in the vicinity of the discharge port 20 to reach the level of the discharge port 20. Still further, the uppermost end 52*a* of the partition wall 52, i.e., the lower end 18*c* of the third communication port 18, is located at a position higher than a lower end of the return screw 19 and lower than an upper end of the return screw 19.

As described above, the developing apparatus 1 of the present embodiment is provided with the third communication port 18 downstream of the first communication port 16 of the partition wall 15. The third communication port 18 is disposed at the position facing the return screw 19 when viewed from the horizontal direction. That is, the first communication port 16 through which the developer is delivered from the agitating chamber 12 to the developing chamber 11 is practically enlarged by the third communication port 18 as compared to the prior art developing apparatus. Accordingly, even if fluidity of the developer drops, the developer is hardly rotated together with the developing sleeve 3 because the developer is not suppressed from being delivered from the agitating chamber 12 to the developing chamber 11. Still further, the lower end 18*c* of the third communication port 18 is defined above the lower end 16*c* of the first communication port 16 as described above. This arrangement hardly suppresses the discharge of the developer because the partition wall 52 prevents the developer from entering the third communication port 18 even if the first communication port 16 is practically enlarged to the return screw 19. Because the delivery of the developer from the agitating chamber 12 to the developing chamber 11 is thus adequately made without suppressing the discharge of the developer out of the discharge port 20, the occurrence of the image defect caused by the delivery and discharge of the developer can be reduced.

It is noted that while the first, second and third communication ports are defined through the partition wall 15 in the present embodiment, it is also possible to configure such that a wall through which first and second communication ports are defined is different from a wall through which a third communication port is defined.

Other Embodiment

It is noted that while the embodiment described above has been described based on the image forming apparatus 100 of the intermediate transfer type in which the toner images of the respective colors are primarily transferred from the photosensitive drums 10 of the respective colors onto the intermediate transfer belt 25 and then the composite toner images of the respective colors are collectively and secondarily transferred onto the recording material S, the present disclosure is not limited to such configuration. For instance, the image forming apparatus may be a direct transfer type in which toner images are directly transferred from the photosensitive drums onto a recording material carried and conveyed by a transfer material conveyance belt.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-086443, filed on Apr. 22, 2016, which is hereby incorporated by reference herein in its entirety.

What is claimed is:

1. A developing apparatus, comprising:

a developer bearing member configured to be rotatable;

a first chamber configured to supply developer to the developer bearing member;

a second chamber configured to collect the developer conveyed from the developer bearing member and to form a circulation path of the developer with the first chamber;

a first wall dividing the first chamber from the second chamber and through which a first communication port for delivering the developer from the second chamber to the first chamber and a second communication port for delivering the developer from the first chamber to the second chamber are defined;

a first screw disposed within the first chamber and conveying the developer in a first direction;

a second screw disposed within the second chamber, comprising a first conveyance portion configured to convey the developer in a second direction opposite to the first direction and a return portion provided downstream of the first communication port in the second direction, the return portion being configured to convey the developer in the first direction;

a discharge portion provided, in the second chamber, downstream of the return portion in the second direction to discharge the developer out of the second chamber; and a second wall through which a third communication port disposed upstream of the discharge portion in the second direction is defined to deliver the developer from the second chamber to the first chamber, the second wall facing at least a part of the return portion in a view from a horizontal direction such that a lower end of the third communication port is located above a lower end of the first communication port.

2. The developing apparatus according to claim 1, wherein the first and second screws are disposed such that a lower end of the second screw is located vertically higher than a lower end of the first screw and at least a part of the first screw overlaps with the second screw in a view from a horizontal direction.

3. The developing apparatus according to claim 1, further comprising a developing container including a third wall at a downstream end in the second direction of the second chamber and through which the discharge portion is defined.

4. The developing apparatus according to claim 1, wherein the second screw comprises a rotary shaft and a spiral blade formed around the rotary shaft, and wherein the discharge portion is defined such that a part of the rotary shaft around which no blade of the second screw is formed penetrates through the discharge portion and such that a gap is created around an outer circumference of the rotary shaft.

5. The developing apparatus according to claim 1, wherein the third communication port is defined such that a lower end of the third communication port is located between upper and lower ends of the discharge portion in the view from the horizontal direction.

6. The developing apparatus according to claim 1, wherein the lower end of the third communication port is located above a lower end of the return portion and below an upper end of the second screw.

7. The developing apparatus according to claim 1, wherein a length of the third communication port in the second direction is longer than a length of the return portion.

8. The developing apparatus according to claim 1, wherein the discharge portion is a first discharge port, and a second discharge port for discharging the developer out of the developing apparatus is located downstream of the first discharge port in the second direction.

* * * * *